US006295846B1

(12) United States Patent
Roell

(10) Patent No.: US 6,295,846 B1
(45) Date of Patent: Oct. 2, 2001

(54) METHOD FOR PRODUCING A KNITTED FABRIC CONTAINING A FLOCK-YARNED IN A FLATBED KNITTING MACHINE

(75) Inventor: Friedrich Roell, Biberach (DE)

(73) Assignee: Recaro GmbH & Co., Kircheim-Teck (DE)

( * ) Notice: Subject to any disclaimer, the term of this patent is extended or adjusted under 35 U.S.C. 154(b) by 0 days.

(21) Appl. No.: 09/284,535

(22) PCT Filed: Oct. 15, 1997

(86) PCT No.: PCT/DE97/02365

§ 371 Date: Apr. 13, 1999

§ 102(e) Date: Apr. 13, 1999

(87) PCT Pub. No.: WO98/16675

PCT Pub. Date: Apr. 23, 1998

(30) Foreign Application Priority Data

Oct. 15, 1996 (DE) ..... 196 42 595

(51) Int. Cl.[7] ..... D04B 7/14

(52) U.S. Cl. ..... 66/190; 66/202

(58) Field of Search ..... 66/202, 169 R, 66/170, 190, 191, 192, 193, 194, 195; 442/304, 308, 318

(56) References Cited

U.S. PATENT DOCUMENTS

| | | | | |
|---|---|---|---|---|
| 4,125,001 | | 11/1978 | Bryars . | |
| 4,712,281 | * | 12/1987 | Scheller | 66/202 |
| 4,841,607 | * | 4/1991 | Sekino | 66/202 |
| 5,009,946 | * | 4/1991 | Hatomoto et al. | 66/202 |
| 5,428,969 | * | 7/1995 | Day et al. | 66/202 |

FOREIGN PATENT DOCUMENTS

| | | |
|---|---|---|
| 30 23 249 | 1/1981 | (DE) . |
| 0 179 340 | 4/1986 | (EP) . |
| 0 627 516 | 12/1994 | (EP) . |
| 2 047 761 | 12/1980 | (GB) . |

* cited by examiner

*Primary Examiner*—Danny Worrell
(74) *Attorney, Agent, or Firm*—Smith-Hill and Bedell

(57) ABSTRACT

The invention relates to a method of producing a flake-yarned knit as required more particularly in achieving velour-type coverings. In this method the flake thread is bound in as a weft and/or warp thread in the knit on a flat knitting machine.

19 Claims, 2 Drawing Sheets

Figure 1:
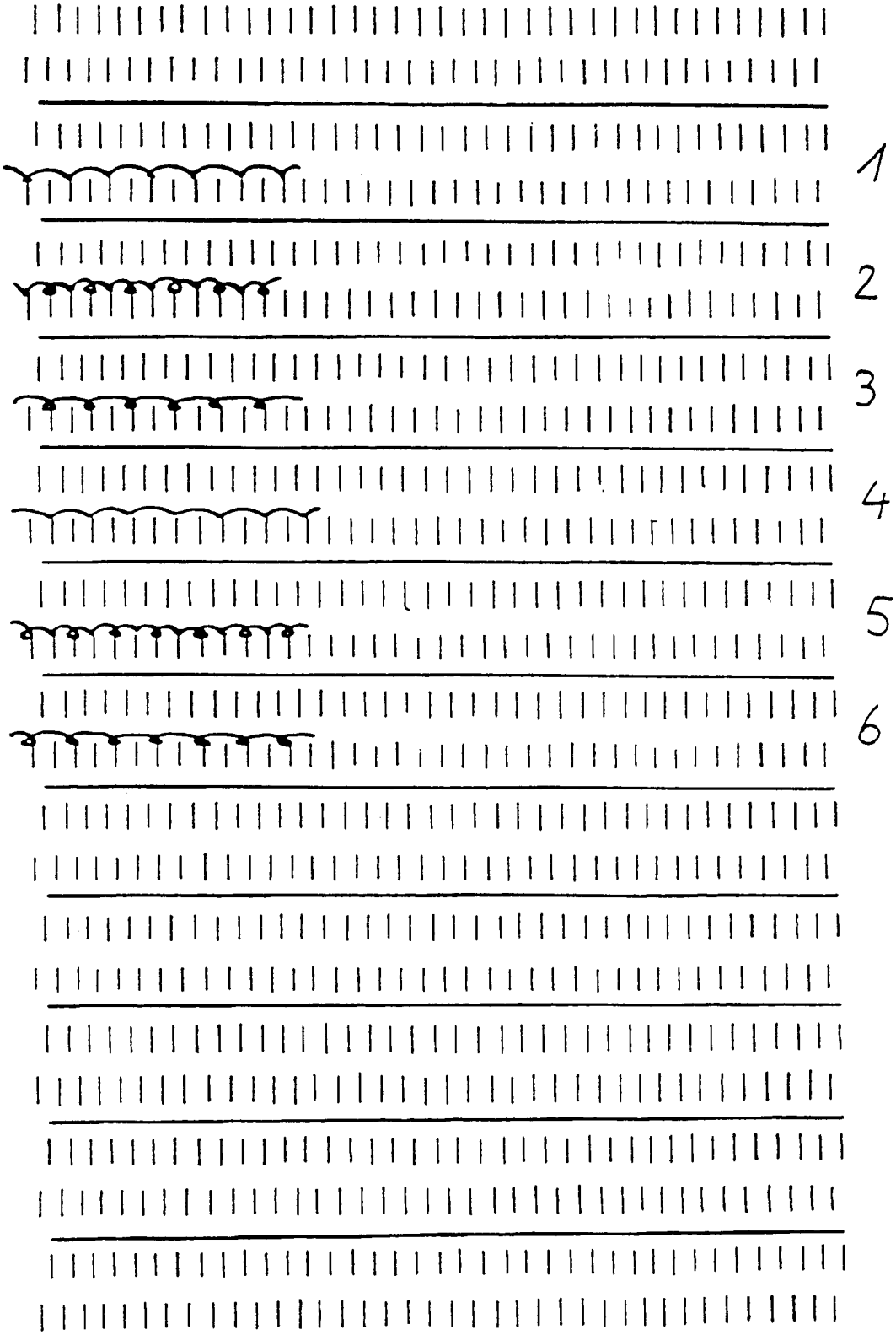

METHOD FOR PRODUCING A KNITTED FABRIC CONTAINING A FLOCK-YARNED IN A FLATBED KNITTING MACHINE

The present invention relates to a method of producing a flock-yarned knit on a flat knitting machine as needed in the production of velour-type seat covers.

Hitherto velour fabrics are woven, which in the production of seat covers necessitates fabrication, i.e. cutting to size and stitching individual webs of textiles.

It is thus the object of the present invention to produce a velour-type fabric by simple means permitting translation into three-dimensional shapes without fabrication.

To start with, the method differs basically from known methods of producing velour fabrics by this fabric being knitted on a flat knitting machine instead of being woven. To endow the fabric with a velour-type character a flock thread is employed, i.e. a thread provided with a plurality of tiny hairs standing off transversely from the run of the thread, such flock threads being readily available commercially.

However, such threads are relatively stiff, this being the reason why these threads have hitherto only found application in weaving technology to achieve a velour fabric. Working a flock thread into a knit has proven to be exceedingly difficult since looping the relatively stiff flock thread in the knit is hardly achievable by machine means. In accordance with the invention the flock thread is now no longer looped in the knit as a usual looping thread, it instead being bound in the basic knit as a weft and/or warp thread. This weft and/or warp thread may be either looped in largish spacings or tucked in defined spacings.

More particularly, working-in a flock thread as a weft and/or warp thread into the outer, i.e. the upper ply of a multi-ply knit is a good proposition when this knit is intended for use e.g. as a vehicle seat cover or a mobile seat cover.

Preferably, the flock threads running in the knit as weft or warp thread are bound in by a binding thread. The binding thread which may be run perpendicular, parallel or oblique to the flock thread, may be employed not only by its bind in the knit for binding the flock thread, but also used to achieve a specific pattern by correspondingly varying the guidance of the binding thread in the knit so that the binding thread has not just a fastening function for the flock thread in the knit, it additionally serving to enhance the visual effect. The color or the material aspects of the flock thread may be altered within the knit. When, for instance, the material aspects of the binding thread in the knit are alternated, differing demands in various portions of the seat cover may be taken into account by, for instance the seating surface area being stressed very much more than the backrest of a seat cover. Accordingly, a very much tougher binding thread could be put to use in the seating surface area than, for example, in the backrest. Achieving a tougher portion is also possible by a denser binding of the binding thread or by making use in part of a thicker binding thread. Furthermore, by alternating the color of the binding thread a specific desired visual effect, e.g. a logo may be applied to the surface of the cover. A desired visual effect may also be achieved, apart from changing the color, material or thickness of the binding thread in part, also by a particular design in guiding the binding thread relative to the flock thread or by a specific bind of the binding thread. Thus, for instance, parts of the flock thread may be totally covered in part by the binding thread so that in these portions only the binding thread is visual instead of the flock thread. In this way both the flock thread is stabilized in the knit and a desired visual effect is achieved. The binding thread may also be produced of an elastic or thermal post-shrinking material which contracts following a thermal after-treatment, it not being until then that it ensures proper stabilization of the flock thread in the knit.

Preferably the flock thread is thermally treated prior to it being bound, so that the hairs of the flock thread stand on end, for this purpose the flock thread being passed through a heating tunnel or over a thermal brush or heating roll.

To achieve good binding of the flock thread in the knit the flock thread is preferably impressed into the needle bed of the flat knitting machine by a defined force by sinkers and/or sweep-ins, enabling knit portions to be produced with a defined variable stability or elasticity. Enhancing the stability may also be achieved by binding-in the flock thread with a looped binding thread which impresses the flock thread into the knit.

As already indicated above, binding-in the flock thread by the binding thread may be varied over the width of the needle bed and/or from course to course, enabling a velour character to be achieved exclusively in certain defined portions. One approach, for example, would be to restrict the velour character solely to the seating surface area facing upwards and the backrest portion facing the person and to leave out the side portions surrounding the seat frame.

Highly appealing visuals effects are achievable by dying and/or finishing the flock thread different to that of the binding thread. Defining the flock thread to great advantage by the binding thread is attained by binding-in the flock thread to tuck by the binding thread so that the flock thread is hardly deformed by being bound in which is very easy to achieve technically on a flat knitting machine. The flock thread may also be selectively tucked at a looping thread or binding thread, the tuck loops preferably having a spacing of two to ten loops or wales depending on the spacing. The flock thread may also be looped in spacings, of course, the spacing of the loops needing to be selected larger since forming a loop with the relatively stiff flock thread greatly stresses the knitting machine.

The flock thread may also be defined in the knit by an additional binding thread when the knit is presented shifted front/rear 1×1 in a two-bed machine, before wefting the flake thread and binding it in place by front/rear and/or rear/front loop transfer of the binding thread.

A velour cover produced by the method in accordance with the invention is thus very easy to configure partially in keeping with mechanical stress requirements and is implementable highly individualized as regards both its shaping and its patterning.

It is naturally not necessary to run a flake thread in every course when wefting the flake thread, i.e. the density of the visual effect is freely definable by selecting the spacings between the individual flock threads accordingly. It likewise not being necessary to include a flock thread in every wale when the flock thread is warped in the knit, i.e. here too, a defined velour density being achievable by setting the spacing individually. In addition, no or also normal threads may be wefted and/or warped alternatedly in a defined scheme, thus enabling patterning as desired to be achieved. By a defined selection of the binding loops, i.e. the loops of the binding thread, also in combination with a loop transfer or other needles or needle beds attractive patterns are achievable. The flock thread may also be warped and wefted in a mutual weave in the knit (by means of the flat knitting machine) in a sequential combination of the flock thread passages with the binding thread passages.

For defining the flock thread on the knit by means of a binding thread a single-ply bind is preferably suitable for producing a seat cover sack cover by varying the selection of the needle width or also in a contoured design, the important thing always being a homogenous connection of the correspondingly border loops.

All of the binding and individualized patterning techniques as cited above are achievable with optimized material employment.

A flake thread must not necessarily consist of a single supporting thread, it may also consist of several supporting threads to which the flock hairs are applied transversely to the direction of the supporting thread preferably by bonding, flock threads of this kind being readily commercially available.

The important thing is controlling insertion of the flock thread relative to other components of the knit such as the binding yarn, i.e. binding thread, pile thread in multi-ply knits and weft and/or warp threads of normal thread materials, i.e. other than flock yarns. Specific countourings, structures and patterns are all achievable by likewise binding-in a flock thread by means of a binding thread individually controlled, the binding thread representing the normal looping thread as a rule. The binding thread may be configured principally as a normal looping thread forming the knit by its looping. The binding thread or also several binding threads may also be incorporated additionally, however, as the second looping thread or as weft and/or warp thread, it being the way in which one or more additional binding threads is looped with the looping thread and/or the flock thread that may then be made use of to achieve a desired visual effect, in addition to binding the flock thread. When an elastic or post-shrinkable material is selected as the binding thread the stability of the cover and/or the velour density is even further improved. In a multi-ply knit a very positive effect is achievable by arranging the flock thread structure in the first ply and joining this first ply to a second ply by a pile thread structure thus enabling velcro structure or loops to be defined in a knit on a support having a complementary velcro structure, it, of course, not being necessary to achieve joining the plies by a pile thread structure.

The velcro structure may also be applied, of course, to the rear side of a single-ply knit, the loops of the velcro structure being formed by the looping thread, the binding thread or even the flock thread itself.

Figure 2:
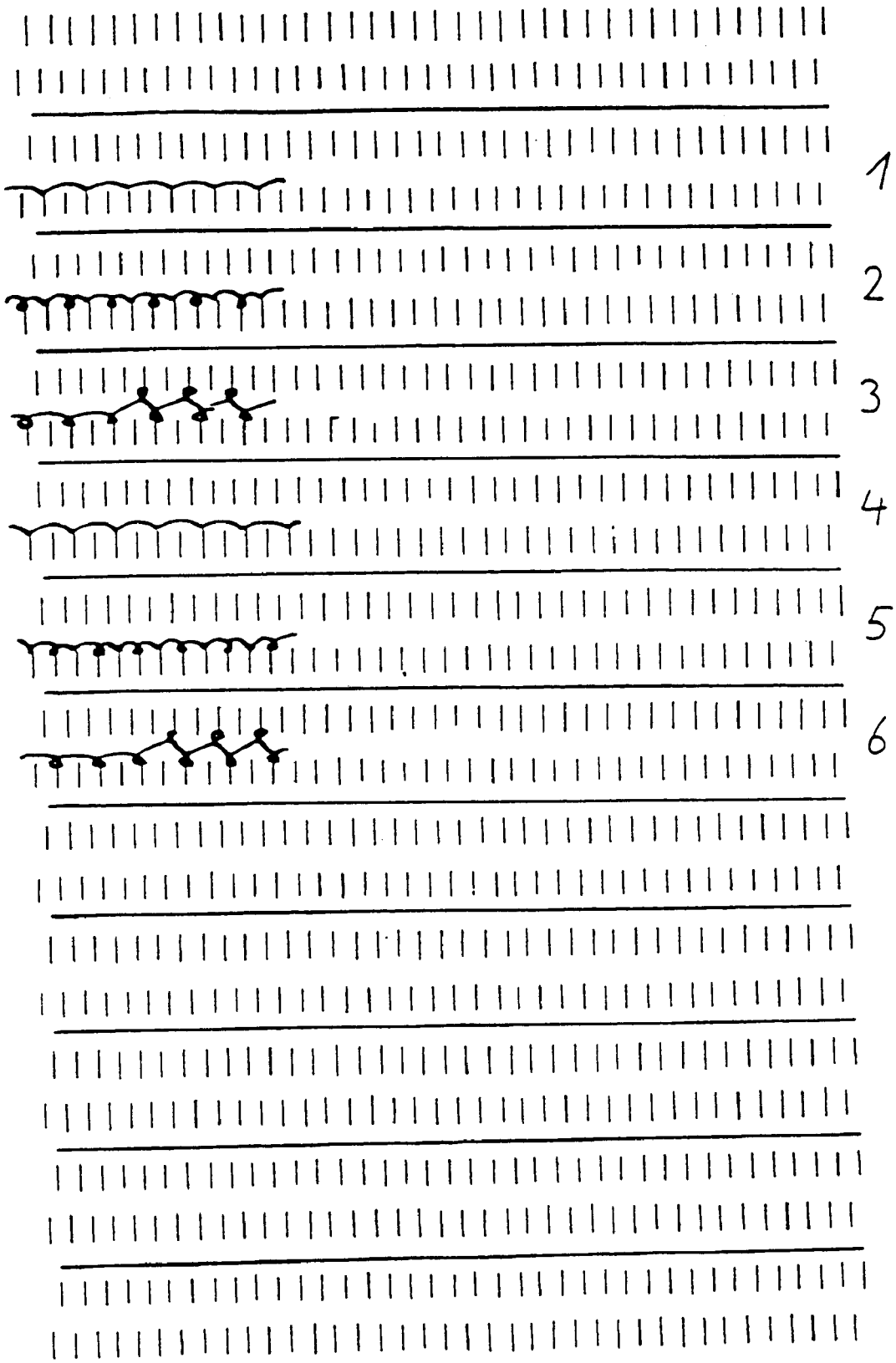

FIGS. 1 and 2 illustrate two examples of how loops are configured in a flock-yarned knit in accordance with the present invention.

Referring now to FIG. 1 there is illustrated a basic looping configuration of a flock-yarned knit. In the first course 1 the flock thread is tucked in every second loop on a first binding thread which is the looping thread. Course 2 shows looping the first binding thread. In the third course a second binding thread is looped with the looping thread in every second loop. This second binding thread serves to impress the flock thread in the knit, and may also be eliminated in principle when the flock thread is impressed into the knit by sweeping. Course 4 is a repeat of course 1.

Referring now to FIG. 2 there is illustrated a jacquard-patterned flock thread knit. The first two courses correspond to the basic knit as shown in FIG. 1. The third course shows a second binding thread partially looped (in the first six loops) to the first binding thread, i.e. neutral (not covering) the flock thread, and partially (in the second six loops) offset 1×1 on two needle beds. In these portions it covers the flock thread almost completely and thus highlights the visual effect instead of the flake thread. By defining the control of these covering and non-covering portions any desired pattern, in this case a jacquard pattern, is achievable.

What is claimed is:

1. A method of producing a flock-yarned knit on a flat knitting machine, comprising:

forming a knit with looped thread material other than flock thread, and binding flock thread into the knit as unlooped warp thread, as unlooped weft thread or as both unlooped warp thread and unlooped weft thread.

2. A method according to claim 1, comprising forming a multi-ply knit and binding the flock thread into only a first ply of the knit.

3. A method according to claim 2, wherein the multiply knit includes a single ply containing a hook and loop fastener structure or loops and the method comprises joining the first ply to the single ply by a pile thread structure.

4. A method according to claim 1, comprising binding the flock thread into the knit using a binding thread.

5. A method according to claim 4, comprising binding the flock thread into the knit by tucking the binding thread.

6. A method according to claim 4, further comprising varying the run of the binding thread over the width of the needle bed, over various courses or over both the width of the needle bed and various courses.

7. A method according to claim 4, further comprising varying the material of the binding thread over the width of the needle bed, over various courses over both the width of the needle bed and various courses.

8. A method according to claim 1, comprising binding the flock thread into the knit using an elastic binding thread.

9. A method according to claim 1, comprising binding the flock thread into the knit employing a binding thread of a thermal post-shrinking or stabilizing material.

10. A method according to claim 1, comprising thermally treating the flock thread prior to binding the flock thread into the knit.

11. A method according to claim 1, comprising thermally treating the flock thread prior to binding the flock thread into the knit by passing the flock thread through a heating tunnel or over a thermal brush or heating roll.

12. A method according to claim 1, comprising impressing the flock thread in the needle bed by plates, by sweepers or by both plates and sweepers.

13. A method according to claim 1, comprising binding the flock thread into the knit with a binding thread and wherein the binding in of the flock thread by the binding thread is varied over the width of the needle bed.

14. A method according to claim 1, comprising binding the flock thread into the knit with a binding thread and varying the binding in of the flock thread by the binding thread from course to course.

15. A method according to claim 1, comprising using flock threads that differ from one another in color, in finish or in both color and finish.

16. A method according to claim 1, comprising binding the flock thread into the knit using a binding thread that varies in color, in finish or in both color and finish.

17. A method according to claim 1, comprising forming a single ply knit having first and second sides, running the flock thread on a first side of the knit and integrating loops in the knit on the second side.

18. A method according to claim 1, comprising selectively tucking the flock thread.

19. A flock-yarned knit made on a flat knitting machine by a method comprising:

forming a knit with looped thread material other than flock thread, and binding flock thread into the knit as unlooped warp thread, as unlooped weft thread or as unlooped warp and weft thread.

* * * * *